US010328549B2

(12) United States Patent
Hsu et al.

(10) Patent No.: US 10,328,549 B2
(45) Date of Patent: Jun. 25, 2019

(54) POLISHING HEAD, CHEMICAL-MECHANICAL POLISHING SYSTEM AND METHOD FOR POLISHING SUBSTRATE

(71) Applicant: TAIWAN SEMICONDUCTOR MANUFACTURING CO., LTD., Hsinchu (TW)

(72) Inventors: Shu-Bin Hsu, Taichung (TW); Ren-Guei Lin, Taichung (TW); Feng-Inn Wu, Taichung (TW); Sheng-Chen Wang, Taichung (TW); Jung-Yu Li, Taichung (TW)

(73) Assignee: Taiwan Semiconductor Manufacturing Co., Ltd., Hsinchu (TW)

( * ) Notice: Subject to any disclaimer, the term of this patent is extended or adjusted under 35 U.S.C. 154(b) by 0 days.

(21) Appl. No.: 14/103,629

(22) Filed: Dec. 11, 2013

(65) Prior Publication Data

US 2015/0158140 A1 Jun. 11, 2015

(51) Int. Cl.
*B24B 37/26* (2012.01)
*B24B 57/02* (2006.01)

(52) U.S. Cl.
CPC ..... *B24B 37/26* (2013.01); *B24B 57/02* (2013.01)

(58) Field of Classification Search
USPC ..... 156/345.12, 345.13, 345.15
See application file for complete search history.

(56) References Cited

U.S. PATENT DOCUMENTS 4,606,151 A * 8/1986 Heynacher ..... 451/42
5,720,845 A * 2/1998 Liu ..... B24B 37/30 156/345.13
5,868,896 A 2/1999 Robinson et al.
5,944,580 A 8/1999 Kim et al.
5,980,361 A * 11/1999 Muller ..... B24B 37/30 451/288
6,179,956 B1 * 1/2001 Nagahara et al. ..... 156/345.14
6,394,882 B1 * 5/2002 Chen ..... 451/41
6,558,232 B1 * 5/2003 Kajiwara ..... B24B 37/30 451/288
6,863,771 B2 * 3/2005 Brown ..... 156/345.14
7,008,299 B2 * 3/2006 Chandrasekaran ..... B24B 37/04 451/159
7,166,019 B2 * 1/2007 Park et al. ..... 451/287
(Continued)

FOREIGN PATENT DOCUMENTS

CN 1185028 A 6/1998
CN 1698185 A 11/2005
(Continued)

OTHER PUBLICATIONS

Machine Generated English Translation of JP2002-079454 published Mar. 19, 2002.*
(Continued)

*Primary Examiner* — Sylvia MacArthur
(74) *Attorney, Agent, or Firm* — McDermott Will & Emery LLP

(57) ABSTRACT

A polishing head includes a carrier head and a plurality of pressure units arranged on the carrier head. At least two of the pressure units are located on the same circumferential line relative to a center axis of the carrier head.

20 Claims, 9 Drawing Sheets

(56) References Cited

U.S. PATENT DOCUMENTS

| | | | | |
|---|---|---|---|---|
| 7,670,206 | B2 | 3/2010 | Togawa et al. | |
| 2007/0167110 | A1* | 7/2007 | Tseng | B24B 37/30 451/5 |
| 2014/0027407 | A1* | 1/2014 | Deshpande et al. | 216/53 |
| 2014/0370787 | A1* | 12/2014 | Duescher | B24B 37/30 451/41 |
| 2015/0158140 | A1* | 6/2015 | Hsu et al. | 156/345.12 |

FOREIGN PATENT DOCUMENTS

| | | | | |
|---|---|---|---|---|
| CN | 101722469 | A | | 6/2010 |
| JP | 09-076152 | A | | 3/1997 |
| JP | 09076152 | A | * | 3/1997 |
| JP | 2002-079454 | A | | 3/2002 |
| JP | 2005-011977 | A | | 1/2005 |
| KR | 10-2005-0008231 | A | | 1/2005 |
| KR | 1020050008231 | A | * | 1/2005 |

OTHER PUBLICATIONS

Machine Generated English Translation of KR 1020050008231. Published Jan. 21, 2005.*

Machine Generated English Translation of Yamamori Atsushi published Mar. 25, 1997.*

* cited by examiner

POLISHING HEAD, CHEMICAL-MECHANICAL POLISHING SYSTEM AND METHOD FOR POLISHING SUBSTRATE

BACKGROUND

Chemical-mechanical polishing (CMP) is a process in which an abrasive and corrosive slurry and a polishing pad work together in both the chemical and mechanical approaches to flaten a substrate. In general, the current design of a polishing head of a CMP system allows control on its polish profile. However, an asymmetric topography of the polish profile still exists.

DETAILED DESCRIPTION

Figure 1:
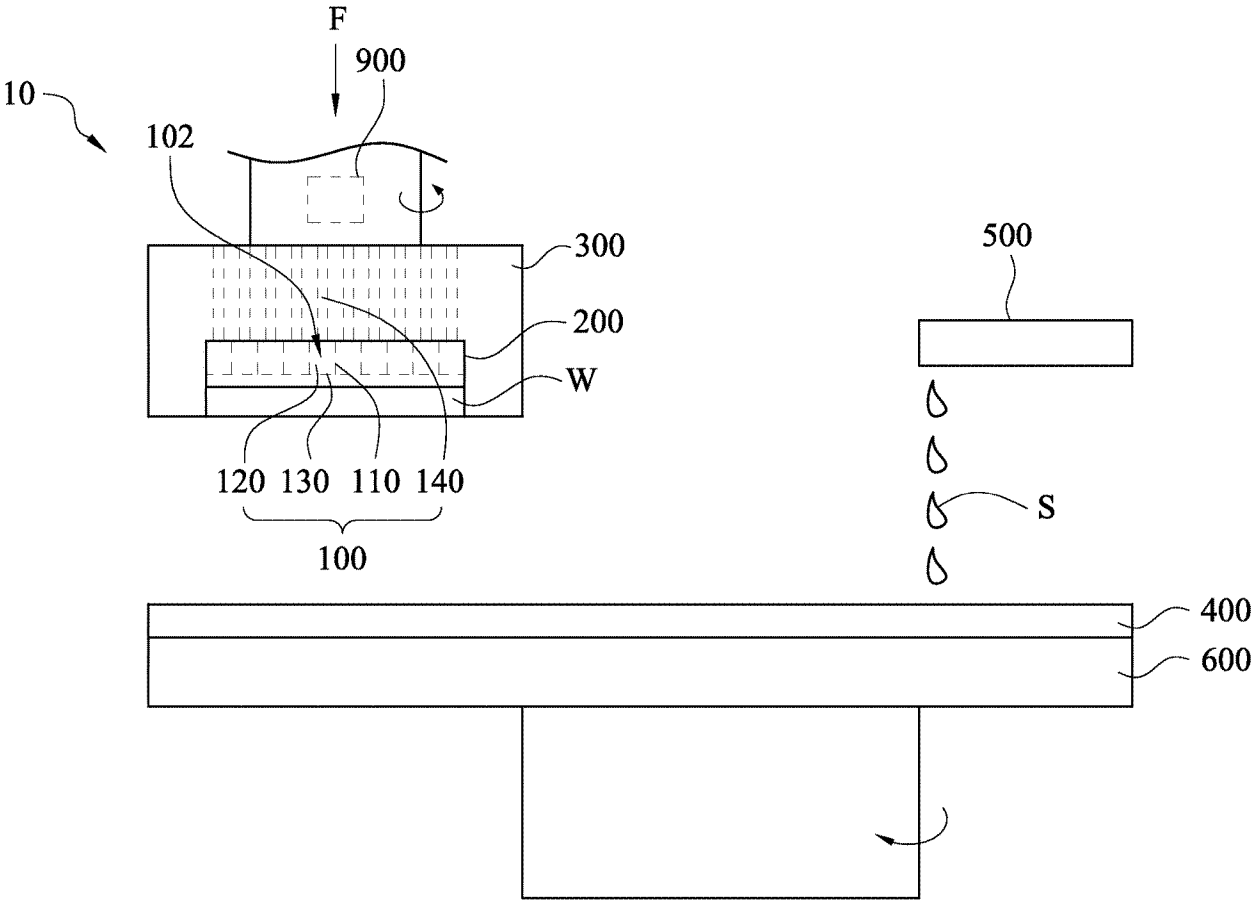
FIG. 1 is a schematic view of a chemical-mechanical polishing system according to some embodiments of the present disclosure.

In the following detailed description, for purposes of explanation, numerous specific details are set forth in order to provide a thorough understanding of the disclosed embodiments. It will be apparent, however, to that one or more embodiments may be practiced without these specific details. In other instances, well-known structures and devices are schematically shown in order to simplify the drawing.

Chemical-mechanical polishing is a process to flaten a substrate, or more specific a wafer. FIG. 1 is a schematic view of a chemical-mechanical polishing system according to some embodiments of the present disclosure. As shown in FIG. 1, the chemical-mechanical polishing system includes a polishing head 10, a polishing pad 400, a slurry introduction mechanism 500 and a platen 600. The polishing pad 400 is disposed on the platen 600. The slurry introduction mechanism 500 is disposed above the polishing pad 400. The polishing head 10 includes a plurality of pressure units 100 and a carrier head 300. The pressure units 100 are arranged on the carrier head 300. The pressure units 100 can be actuated to exert force on the substrate W. More particularly, the pressure units 100 can individually exert force on the substrate W.

When the chemical-mechanical polishing system is in use, the polishing head 10 holds a substrate W against the polishing pad 400. Both the polishing head 10 and the platen 600 are rotated, and thus both the substrate W and the polishing pad 400 are rotated as well. The slurry introduction mechanism 500 introduces the slurry S onto the polishing pad 400. For example, the slurry S can be deposited onto the polishing pad 400. The cooperation between the slurry S and the polishing pad 400 removes material and tends to make the substrate W flat or planar.

When the chemical-mechanical polishing system is in use, a downward pressure/downward force F is applied to the polishing head 10, pressing the substrate W against the polishing pad 400. Moreover, localized force may be exerted on the substrate W in order to control the polish profile of the substrate W.

In some embodiments, at least one of the pressure units 100 is a pneumatic pressure unit. For example, as shown in FIG. 1, at least one of the pressure units 100 includes first partition walls 110, second partition walls 120, a bottom wall 130 and a source 140 for introducing fluid. The first partition walls 110 and the second partition walls 120 connect the bottom wall 130 to the carrier head 300 (See FIG. 1), such that the bottom wall 130, the first partition walls 110, the second partition walls 120, and the carrier head 300 define a pressure chamber 102. The source 140 can introduce fluid into the pressure chamber 102. In such a configuration, the pressure chambers 102 can be spaced apart from each other by the partition walls (including the first partition walls 110 and the second partition walls 120). Therefore, the pressure chambers 102 can be not in fluid communication with each other, so as to isolate the fluid introduced into one pressure chamber 102 from another pressure chamber 102, which allows individually pressurizing the pressure chambers 102. In some embodiments, the bottom walls 130, the first partition walls 110, and the second partition walls 120 of the pressure units 100 are made out of one piece of flexible material, so as to form a membrane 200.

Figure 2:
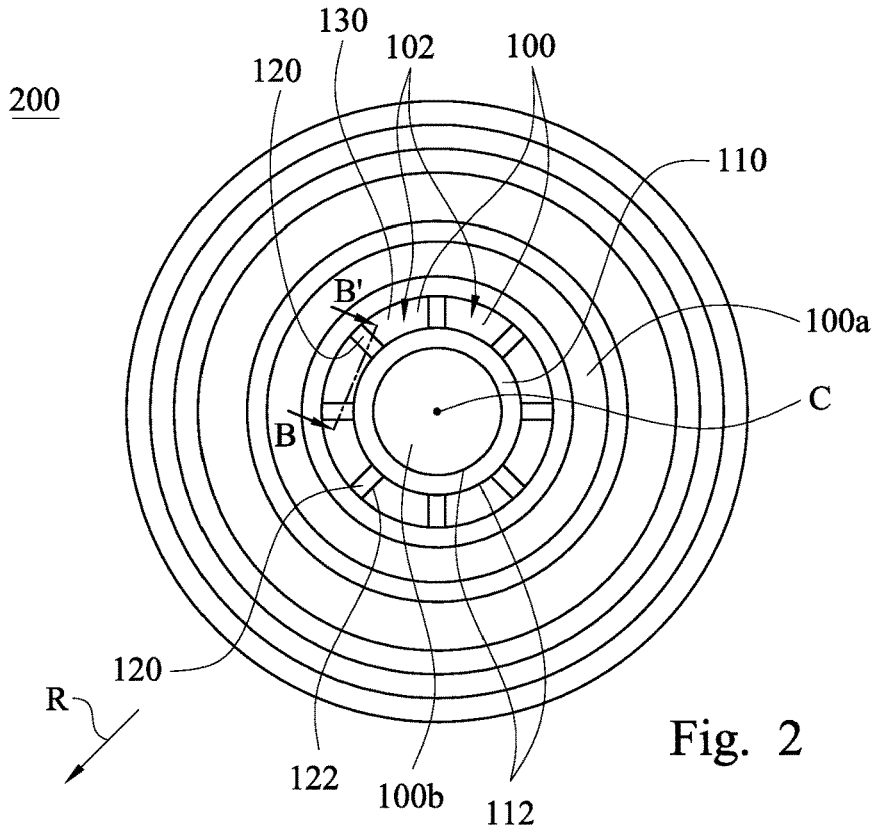
FIG. 2 is a top view of the membrane in FIG. 1.

FIG. 2 is a top view of the membrane 200 in FIG. 1. As shown in FIG. 2, the pressure units 100 are at least partially arranged along at least one circumferential line relative to a center axis C of the carrier head 300 (See FIG. 1). That is, at least two of the pressure units 100 are located on the same circumferential line relative to the center axis C. In this way, the profile control of the substrate W can be carried out along at least one circumferential line relative to the center axis of the substrate W (See FIG. 1).

As shown in FIG. 2, in some embodiments, the first partition walls 110 extend substantially along circumferential directions relative to the center axis C. In other words, the first partition wall 110 is an annular wall. For example, the first partition wall 110 has two circumferential surfaces 112 opposite to each other. The circumferential surfaces 112 are curved substantially along the circumferential directions relative to the center axis C. In some embodiments, the second partition walls 120 extend substantially along radial directions R relative to the center axis C. In other words, the second partition wall 120 can be plate-shaped. For example, the second partition wall 120 has at least one lateral surface 122 connected to the first partition walls 110 and the bottom wall 130. The lateral surface 122 of the second partition wall 120 is substantially parallel to the radial directions R.

As shown in FIG. 2, a pressure chamber 102 is enclosed by two opposite first partition walls 110 and two opposite second partition walls 120. The second partition walls 120 are connected to the circumferential surface 112 of the first partition wall 110 at intervals. In other words, two pressure chambers 102 adjacently arranged along the same circumferential line relative to the center axis C are spatially separated by a second partition wall 120, so that the pressure chambers 102 adjacently arranged along the same circumferential line relative to the center axis C may be not in fluid communication with each other, and therefore, the pressure units 100 may individually provide zonal control for the polish profile of the substrate W (See FIG. 1), which can facilitate to even out the asymmetric topography of the substrate W. For example, when the pressure chambers 102 of the pressure units 100 are individually pressurized, the bottom walls 130 of the pressure units 100 can individually deform and thereby respectively press different zones of the substrate W, so as to even out the asymmetric topography of the substrate W.

As shown in FIG. 2, in some embodiments, the pressure units 100 located on the same circumferential line are substantially equal in size. For example, the pressure units 100 located on the same circumferential line can be in the shape of an annular sector, rather than a complete circle or a complete ring. The annular sectors may have equal area.

As shown in FIG. 2, in some embodiments, the pressure unit 100*a* is an annular pressure unit. Stated differently, the pressure unit 100*a* is in the shape of a ring. In some embodiments, the pressure units 100 located on the same circumferential line are surrounded by the annular pressure unit 100*a*. In other words, the pressure units 100 are closer to the center axis C than the annular pressure unit 100*a* is.

As shown in FIG. 2, in some embodiments, the pressure unit 100*b* is a circle pressure unit. Stated differently, the pressure unit 100*b* is in the shape of a circle. In some embodiments, the pressure unit 100*b* is located substantially on the center axis C.

Figure 3:
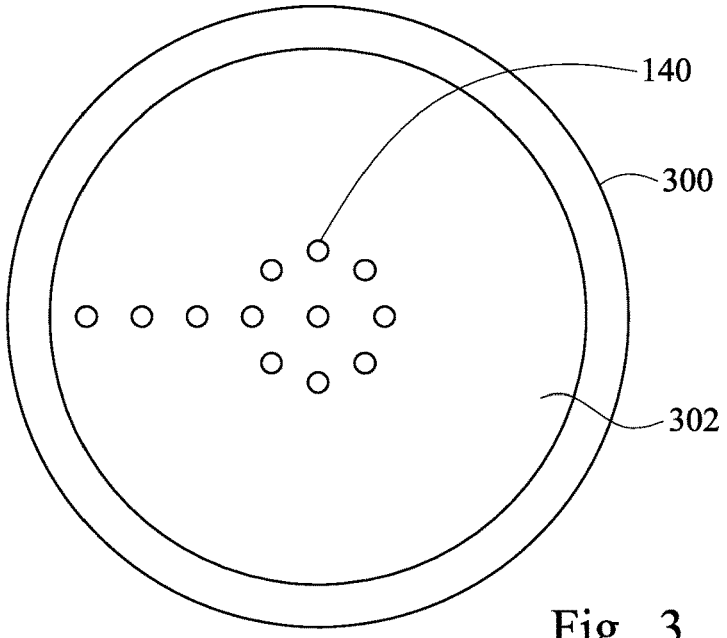
FIG. 3 is bottom view of the carrier head in FIG. 1.

FIG. 3 is bottom view of the carrier head 300 in FIG. 1. As shown in FIG. 3, in some embodiments, the sources 140 can be exposed on a bottom surface 302 of the carrier head 300 for respectively introducing fluid to the pressure chambers 102 (See FIG. 2), such that the bottom walls 130 (See FIG. 2) can respectively press partial zones of the substrate W (See FIG. 1). Hence, the localized force can be applied to the substrate W. In some embodiments, the fluid introduced by the source 140 can be, but is not limited to be, gas. In other words, the source 140 can be, but is not limited to be, a gas source.

Figure 4:
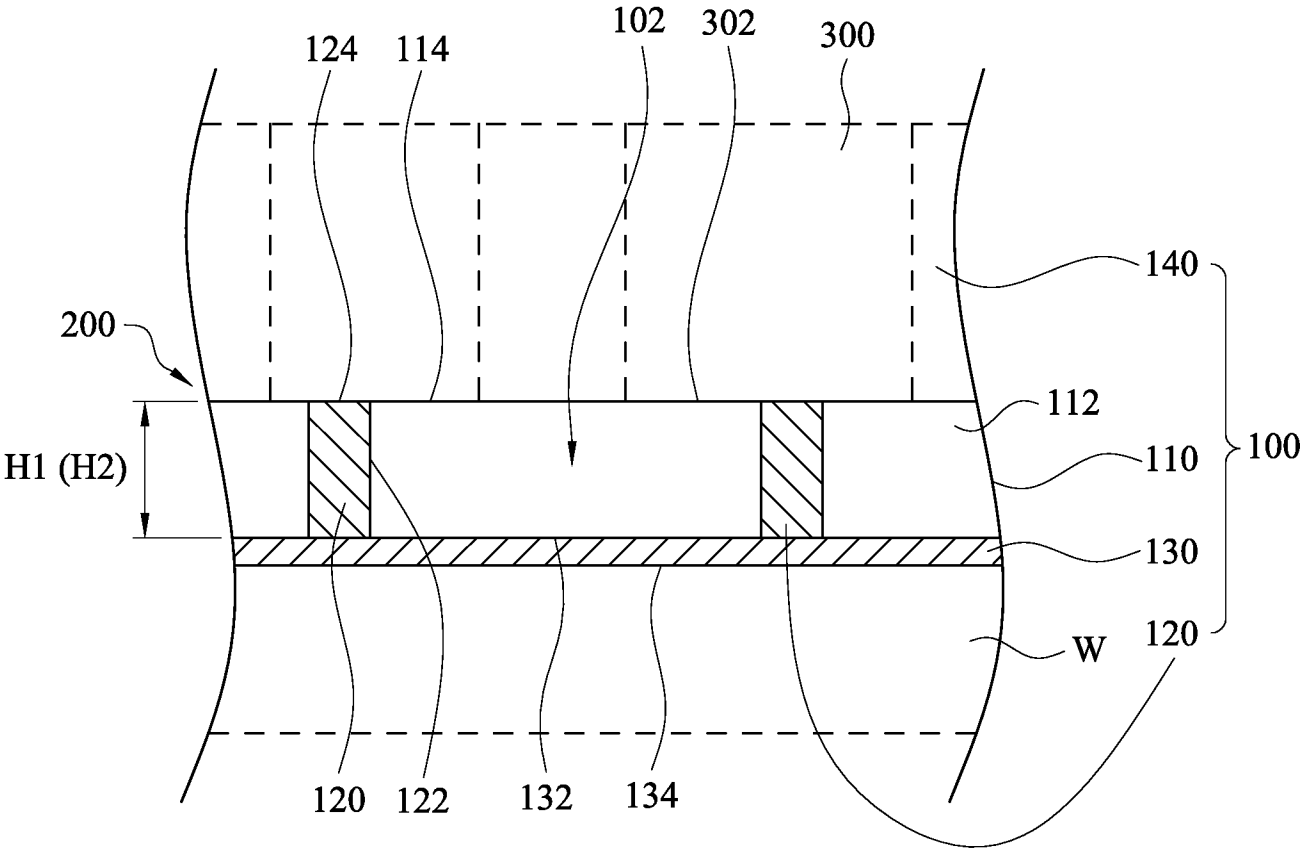
FIG. 4 is a fragmentary cross-sectional view of the membrane taken along B-B' line in FIG. 2.

FIG. 4 is a fragmentary cross-sectional view of the membrane 200 taken along B-B' line in FIG. 2. As shown in FIG. 4, in some embodiments, the sources 140 for introducing fluid are respectively positioned above the pressure chambers 102, so that the pressure chambers 102 can be individually pressurized by different sources 140. In some embodiments, the bottom wall 130 has a fluid receiving surface 132 and a substrate pressing surface 134 opposite to each other. The fluid receiving surface 132 faces toward the source 140. The projection positions that the sources 140 are projected to the fluid receiving surface 132 are spaced apart from the first partition walls 110 and the second partition walls 120, so that a source 140 does not cover two or more pressure chambers 102, which facilitates the sources 140 to individually pressurize the pressure chambers 102.

As shown in FIG. 4, in some embodiments, the first partition wall 110 and the second partition wall 120 are disposed on the same surface of the bottom wall 130. For example, the lateral surface 122 of the second partition wall 120 and the circumferential surface 112 of the first partition wall 110 abut on the fluid receiving surface 132 of the bottom wall 130. Hence, there is no gap between the first partition wall 110 and the bottom wall 130, and there is no gap between the second partition wall 120 and the bottom wall 130 as well. As such, the pressure of one pressure chamber 102 can be independent of the pressure of another pressure chamber 102. Therefore, the force that one pressure unit 100 exerts on the substrate W is independent of the force that another pressure unit 100 exerts on the substrate W.

As shown in FIG. 4, in some embodiments, the first partition wall 110 and the second partition wall 120 are in contact with the carrier head 300. For example, the first partition wall 110 and the second partition wall 120 respectively have a first top surface 114 and a second top surface 124. The first top surface 114 and the second top surface 124 are in contact with the bottom surface 302 of the carrier head 300. In such a configuration, there is no gap between the first partition wall 110 and the carrier head 300, and there is no gap between the second partition wall 120 and the carrier head 300 as well. As such, the pressure of one pressure chamber 102 can be independent of the pressure of another pressure chamber 102. Therefore, the force that one pressure unit 100 exerts on the substrate W is independent of the force that another pressure unit 100 exerts on the substrate W.

As shown in FIG. 4, the first top surface 114 and the second top surface 124 are both distal to the bottom wall 130. In particular, the first top surface 114 is the surface of the first partition wall 110 that is spaced apart from, or stated differently, not in contact with, the fluid receiving surface 132 of the bottom wall 130. Similarly, the second top surface 124 is the surface of the second partition wall 120 that is spaced apart from the fluid receiving surface 132 of the bottom wall 130. In some embodiments, the first top surface 114 is substantially aligned with the second top surface 124, so as to allow the first top surface 114 and the second top surface 124 in contact with the bottom surface 302. In other words, the height H1 of the first partition wall 110 can be substantially equal to the height H2 of the second partition wall 120. The height H1 refers to the distance between the first top surface 114 and the fluid receiving surface 132, and the height H2 refers to the distance between the second top surface 124 and the fluid receiving surface 132.

Reference is now made to FIG. 1. In some embodiments, the polishing head 10 includes a pressure controller 900. The pressure controller 900 is configured for controlling the force exerted on the substrate W. In particular, the pressure controller 900 controls the pressure of the fluid introduced by the source 140. The user can obtain a pre-polish data about the pre-polished profile of a substrate W. For example, the pre-polished data can be obtained by measuring the thickness distribution of the substrate W prior to polishing it. The user can utilize the pressure controller 900 to control the pressure of the fluid introduced by the source 140 based on the pre-polished data. In such a configuration, the pressure chamber 102 can be pressurized based on the pre-polished data determined by the pre-polished profile of substrate W, so as to facilitate to even out the asymmetric topography of substrate W.

Figure 5:
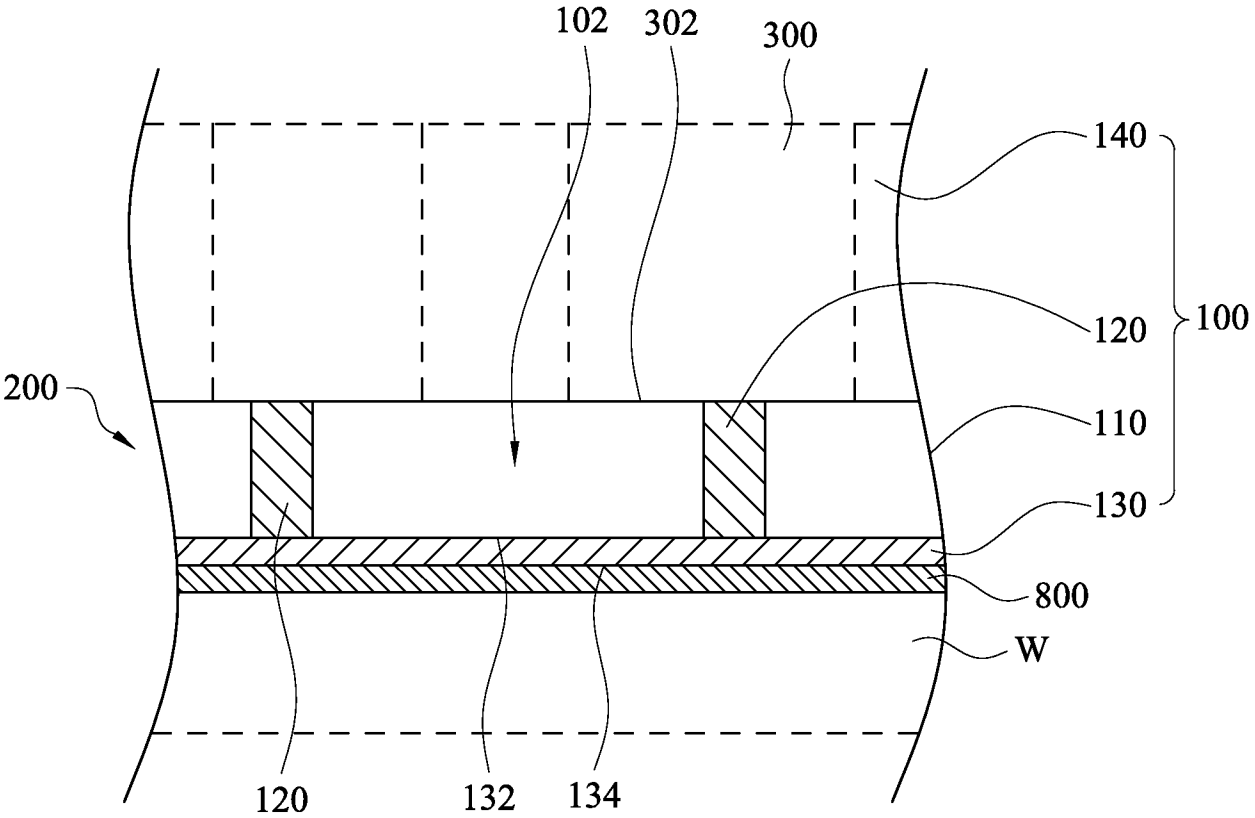
FIG. 5 is a fragmentary cross-sectional view of the membrane in accordance with some embodiments of the present disclosure.

FIG. 5 is a fragmentary cross-sectional view of the membrane 200 in accordance with some embodiments of the present disclosure. As shown in FIG. 5, in some embodiments, at least one piezoelectric layer 800 is disposed on the pressure units 100 for detecting the reaction force by the substrate W when the pressure units 100 are exerting force on the substrate W. The pressure controller 900 (See FIG. 1) can control the force exerted on the substrate W according to the detected reaction force.

Figure 6:
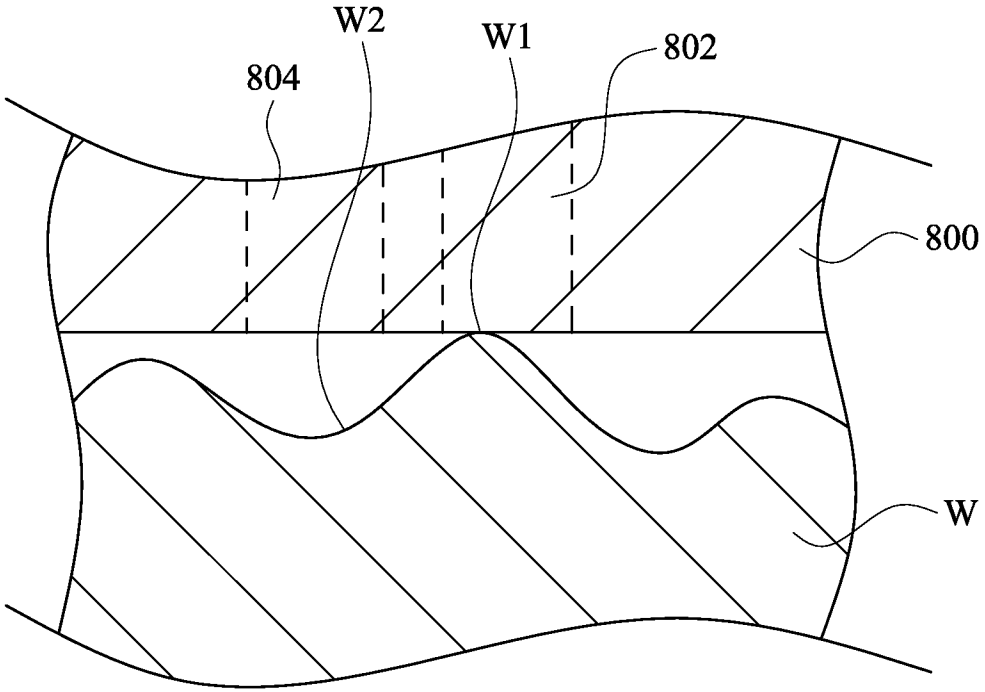
FIG. 6 is an enlarged cross-sectional view of the substrate and the piezoelectric layer.

For example, reference can be now made to FIG. 6, which is an enlarged cross-sectional view of the substrate W and the piezoelectric layer 800. As shown in FIG. 6, the substrate W is uneven, which includes at least one protruded portion W1 and at least one concave portion W2. When the piezoelectric layer 800 moves toward the substrate W, it touches the protruded portion W1 prior to the concave portion W2. When the pressure units 100 (See FIG. 5) exert force on the piezoelectric layer 800 to make the piezoelectric layer 800 pressing the substrate W, the first portion 802 of the piezoelectric layer 800 pressing on the protruded portion W1 bears the reaction force higher than the reaction force that the second portion 804 of the piezoelectric layer 800 pressing on the concave portion W2 bears, and therefore, the voltage generated by the piezoelectric material on the first portion 802 is not equal to the voltage generated by the piezoelectric material on the second portion 804. As such, the voltage difference is determined by the pre-polished profile of the substrate W, especially by the asymmetric topography. Further, the pressure controller 900 (See FIG. 1) controls the pressure of the fluid introduced by the source 140 (See FIG. 1) based on the voltage of the piezoelectric layer 800. In this way, the force exerting on the substrate W can be determined by the pre-polished profile of the substrate W, so as to facilitate to even out the asymmetric topography.

In some embodiments, as shown in FIG. 5, during the CMP process, the piezoelectric layer 800 can keep detecting the reaction force by the substrate W, and the pressure controller 900 (See FIG. 1) can calibrate the force exerting on the substrate W based on the reaction force detected during the CMP process. In this way, the force exerting on the substrate W can be determined by an instant profile of the substrate W during the CMP process, so as to facilitate to even out the asymmetric topography of the substrate W.

In some embodiments, as shown in FIG. 5, the piezoelectric layer 800 can be disposed on the substrate pressing surface 134 of the bottom wall 130 in order to detect the reaction force by the substrate W. For example, during the CMP process, because the piezoelectric layer 800 is disposed on the substrate pressing surface 134, the piezoelectric layer 800 can be sandwiched between the bottom wall 130 and the substrate W, and it can detect the reaction force by the substrate W. In other embodiments, the piezoelectric layer 800 can be positioned within the bottom wall 130. Stated differently, the piezoelectric layer 800 can be sandwiched between the fluid receiving surface 132 and the substrate pressing substrate 134.

Figure 7:
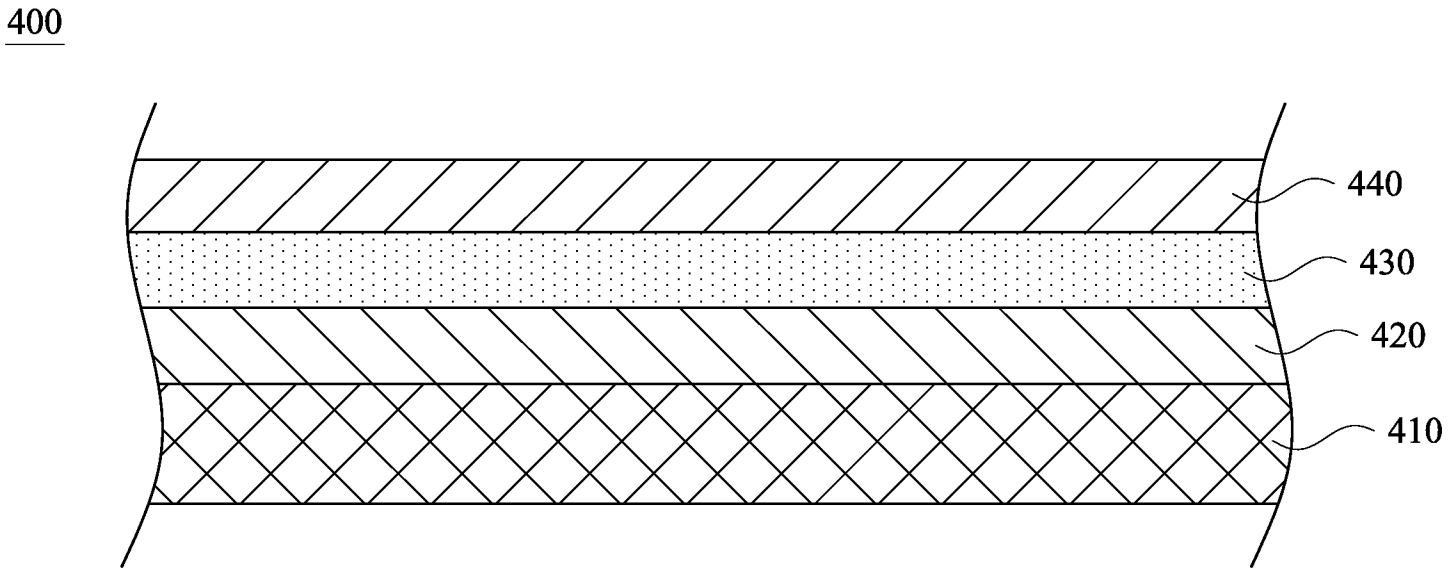
FIG. 7 is a fragmentary cross-sectional view of the polishing pad in accordance with some embodiments of the present disclosure.

FIG. 7 is a fragmentary cross-sectional view of the polishing pad 400 in accordance with some embodiments of the present disclosure. As shown in FIG. 7, in some embodiments, the polishing pad 400 includes a base 410, a connecting layer 430 and a cover layer 440. A piezoelectric layer 420 is disposed on the polishing pad 400. For example, the piezoelectric layer 420 can be disposed on the base 410 of the polishing pad 400. The connection layer 430 can be disposed on the piezoelectric layer 420 opposite to the base 410. The cover layer 440 can be disposed on the connection layer 430 opposite to the piezoelectric layer 420. When the substrate W (See FIG. 1) is positioned on the polishing pad 400 and is pressed by the polishing head 10 (See FIG. 1), the polishing pad 400 exerts force on the substrate W, and the reaction force is exerted on the polishing pad 400 by the substrate W. The piezoelectric layer 420 can detect the reaction force. The pressure controller 900 (See FIG. 1) can control the force exerted on the substrate W according to the reaction force detected by the piezoelectric layer 420.

When the pre-polished substrate W is uneven, different portions of the piezoelectric layer 420 bear unequal forces. The unequal forces induce the piezoelectric material on different portions of the piezoelectric layer 420 to output unequal voltages. Therefore, the voltage difference can be determined by the profile of the substrate W, such as the pre-polished profile of the substrate W, or the instant profile of the substrate W during the CMP process. Further, the pressure controller 900 (See FIG. 1) can control the force exerted on the substrate W based on the voltage of the piezoelectric layer 420. In this way, the force exerted on the substrate W can be determined by the profile of the substrate W that is obtained by the piezoelectric layer 420, so as to facilitate to even out the asymmetric topography of the substrate W. In some embodiments, when the piezoelectric layer 420 is employed, the piezoelectric layer 800 (See FIG. 5) can be omitted. Contrarily, in some embodiments, when the piezoelectric layer 800 is employed, the piezoelectric layer 420 can be omitted. In some embodiments, the piezoelectric layers 420 and 800 can be employed.

As shown in FIG. 7, in some embodiments, the material of the base 410 can be, but is not limited to be, a polymer. In some embodiments, the material of the connection layer 430 can be, but is not limited to be, a glue. In some embodiments, the material of the top layer 440 can be, but is not limited to be, a polymer.

Figure 8:
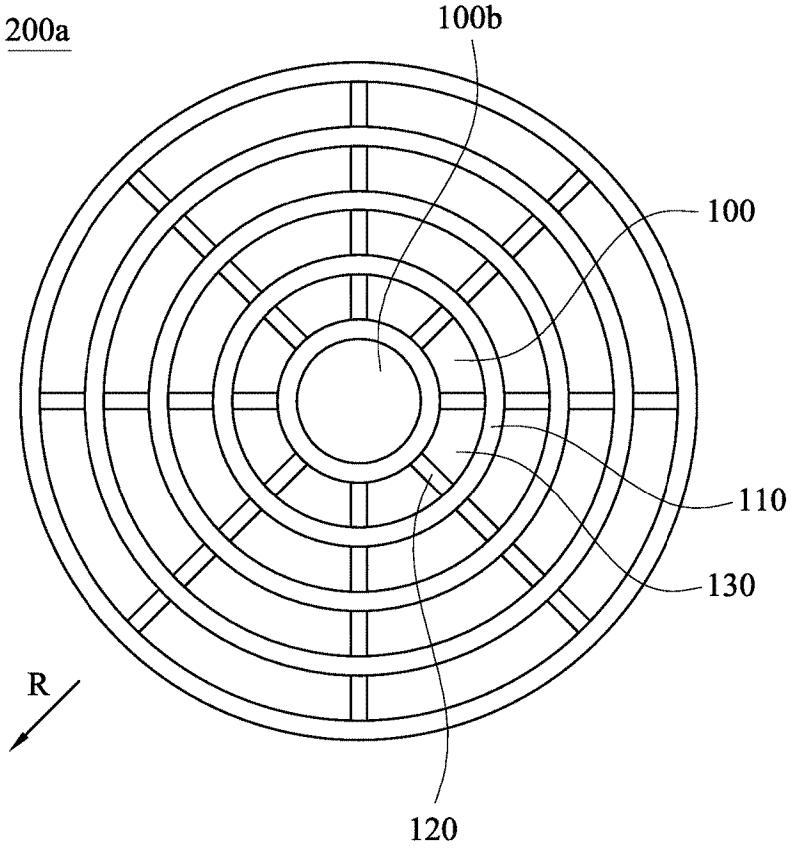
FIG. 8 is a top view of the membrane in accordance with some embodiments of the present disclosure.

FIG. 8 is a top view of the membrane 200*a* in accordance with some embodiments of the present disclosure. As shown in FIG. 8, the main difference between this embodiment and which is shown in FIG. 2 is that the pressure units 100 are not surrounded by the annular pressure unit 100*a* (See FIG. 2). In particular, no annular pressure unit 100*a* is employed.

Figure 9:
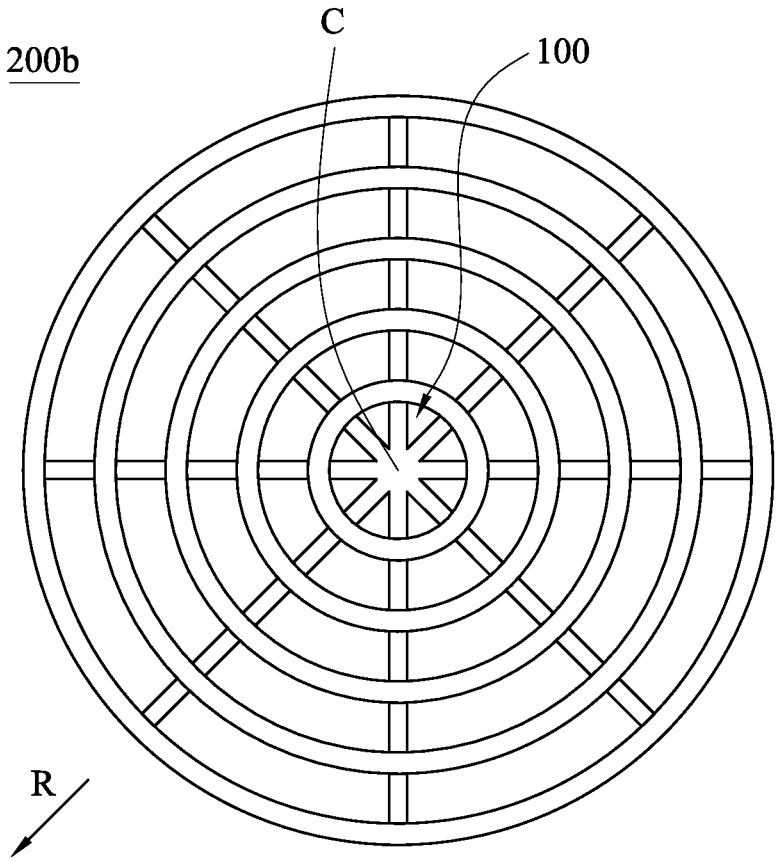
FIG. 9 is a top view of the membrane in accordance with some embodiments of the present disclosure.

FIG. 9 is a top view of the membrane 200*b* in accordance with some embodiments of the present disclosure. As shown in FIG. 9, in some embodiments, the main difference between this embodiment and which is shown in FIG. 2 is that at least two of the pressure units 100 are disposed on the center axis C, and no circular pressure unit 100*b* (See FIG. 2) is employed.

Figure 10:
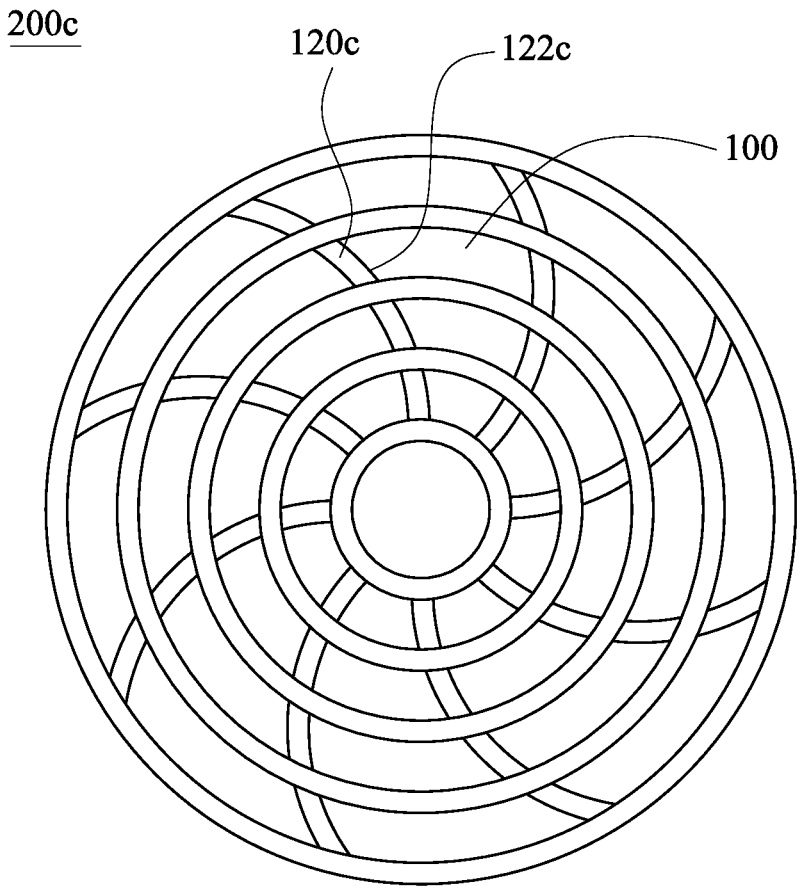
FIG. 10 is a top view of the membrane in accordance with some embodiments of the present disclosure.

FIG. 10 is a top view of the membrane 200*c* in accordance with some embodiments of the present disclosure. As shown in FIG. 10, in some embodiments, at least one of the second partition walls 120*c* is arc-shaped. For example, the lateral surface 122*c* of the second partition wall 120*c* is a curved surface. As such, the boundaries of pressure unit 100 are curved.

In some embodiments, a polishing head is disclosed that includes a carrier head and a plurality of pressure units arranged on the carrier head. At least two of the pressure units are located on the same circumferential line relative to a center axis of the carrier head.

Also disclosed is a chemical-mechanical polishing system that includes a polishing head, a platen and a slurry introduction mechanism. The polishing head includes a carrier head and a plurality of pressure units arranged on the carrier head. The pressure units are at least partially arranged along at least one circumferential line relative to a center axis of the carrier head. The platen is disposed below the polishing head. The slurry introduction mechanism is disposed above the platen.

Also disclosed is a method for polishing a substrate. The method includes the steps below. Slurry is supplied onto a polishing pad. The substrate is held against the polishing pad. At least two pressure units located on the same circumferential line relative to a center axis of the substrate are individually actuated. Both the polishing pad and the substrate are rotated.

The terms used in this specification generally have their ordinary meanings in the art and in the specific context where each term is used. The use of examples in this specification, including examples of any terms discussed herein, is illustrative only, and in no way limits the scope and meaning of the disclosure or of any exemplified term. Likewise, the present disclosure is not limited to various embodiments given in this specification.

It will be understood that, although the terms "first," "second," etc., may be used herein to describe various elements, these elements should not be limited by these terms. These terms are used to distinguish one element from another. For example, a first element could be termed a second element, and, similarly, a second element could be termed a first element, without departing from the scope of the embodiments. As used herein, the term "and/or" includes any and all combinations of one or more of the associated listed items.

As used herein, the terms "comprising," "including," "having," "containing," "involving," and the like are to be understood to be open-ended, i.e., to mean including but not limited to.

The term "substantially" in the whole disclosure refers to the fact that embodiments having any tiny variation or modification not affecting the essence of the technical features can be included in the scope of the present disclosure. The description "feature A is disposed on feature B" in the whole disclosure refers that the feature A is positioned above feature B directly or indirectly. In other words, the projection of feature A projected to the plane of feature B covers feature B. Therefore, feature A may not only directly be stacked on feature B, an additional feature C may intervenes between feature A and feature B, as long as feature A is still positioned above feature B.

Reference throughout the specification to "some embodiments" means that a particular feature, structure, implementation, or characteristic described in connection with the embodiments is included in at least one embodiment of the present disclosure. Thus, uses of the phrases "in some embodiments" in various places throughout the specification are not necessarily all referring to the same embodiment. Furthermore, the particular features, structures, implementation, or characteristics may be combined in any suitable manner in one or more embodiments.

As is understood by one of ordinary skill in the art, the foregoing embodiments of the present disclosure are illustrative of the present disclosure rather than limiting of the present disclosure. It is intended to cover various modifications and similar arrangements included within the spirit and scope of the appended claims, the scope of which should be accorded with the broadest interpretation so as to encompass all such modifications and similar structures.

What is claimed is:

1. A polishing head for a chemical-mechanical polishing system, the polishing head comprising:

a carrier head;

a plurality of fluidly isolated pressure units arranged on the carrier head, wherein at least two of the fluidly isolated pressure units overlap the same circumferential line relative to a center axis of the carrier head, wherein at least one of the pressure units comprises a bottom wall made out of a flexible material; and a piezoelectric layer in a position lower than bottom surfaces of the pressure units, the piezoelectric layer being wider than a pressure chamber in one of the pressure units and having a portion overlapping the pressure chamber.

2. The polishing head of claim 1, wherein the at least one of the pressure units comprises:

at least two opposite first partition walls connecting the bottom wall to the carrier head;

at least two opposite second partition walls connecting the bottom wall to the carrier head, such that the bottom wall, the first partition walls, the second partition walls, and the carrier head define a pressure chamber; and a source for introducing fluid into the pressure chamber.

3. The polishing head of claim 2, wherein the first partition walls extend substantially along circumferential directions relative to the center axis of the carrier head, and the second partition walls extend substantially along radial directions relative to the center axis of the carrier head.

4. The polishing head of claim 3, wherein at least one of the second partition walls is arc-shaped.

5. The polishing head of claim 3, wherein at least one of the second partition walls is plate-shaped.

6. The polishing head of claim 2, wherein the bottom wall, the first partition walls, and the second partition walls are made out of one piece of the flexible material.

7. The polishing head of claim 1, wherein the at least one of the pressure units is a circle pressure unit.

8. The polishing head of claim 1, wherein the at least one of the pressure units is an annular pressure unit.

9. The polishing head of claim 1, wherein the piezoelectric layer abuts the bottom wall of the at least one of the pressure units.

10. The polishing head of claim 1, wherein the polishing head is free of a circular pressure unit.

11. The polishing head of claim 1, wherein an innermost fluidly isolated pressure unit of the fluidly isolated pressure units is in a sector shape.

12. A chemical-mechanical polishing system comprising:

a polishing head comprising a carrier head defining a center axis and a plurality of circumferential lines surrounding the center axis, wherein only one of the circumferential lines has a plurality of fluidly isolated pressure units arranged thereon;

a platen disposed below the polishing head;

a slurry introduction mechanism disposed above the platen;

a piezoelectric layer located under the pressure units;

a partition wall separating pressure chambers in the pressure units, the piezoelectric layer extending across the partition wall; and a bottom wall sealing bottoms of the pressure units.

13. The chemical-mechanical polishing system of claim 12, further comprising:

at least one polishing pad disposed on the platen, wherein the piezoelectric layer is disposed on the polishing pad.

14. The chemical-mechanical polishing system of claim 12, wherein the bottom wall is between the partition wall and the piezoelectric layer.

15. A chemical-mechanical polishing system comprising:

a polishing head comprising:

a carrier head;

a plurality of concentric partition walls;

a plurality of radial partition walls extending from an innermost partition wall of the plurality of the concentric partition walls to an outermost partition wall of the plurality of the concentric partition walls, wherein the radial partition walls are made of a flexible material; and a plurality of individually actuatable pressure units overlapping the same circumferential line relative to a center axis of the carrier head when viewed from above along a direction of the center axis of the carrier head;

a platen disposed below the polishing head;

a slurry introduction mechanism disposed above the platen; and a piezoelectric layer between the platen and the pressure units, a pressure chamber in one of the pressure units being narrower than the piezoelectric layer and overlapping a portion of the piezoelectric layer.

16. The chemical-mechanical polishing system of claim 15, wherein the pressure chambers in the pressure units are fluidly isolated from each other.

17. The chemical-mechanical polishing system of claim 15, wherein the pressure chambers in the pressure units are individually and pneumatically pressurizable.

18. The chemical-mechanical polishing system of claim 15, wherein the carrier head has a bottom surface, wherein at least one of the pressure units comprises:

a bottom wall having a fluid receiving surface, wherein at least two of the concentric partition walls connecting the fluid receiving surface of the bottom wall to the bottom surface of the carrier head, wherein at least two of the radial partition walls connecting the fluid receiving surface of the bottom wall to the bottom surface of the carrier head, such that the bottom wall, the concentric partition walls, the radial partition walls, and the carrier head define the pressure chamber; and a source exposed on the bottom surface for introducing fluid into the pressure chamber, wherein a projection position that the source is projected to the fluid receiving surface is spaced apart from the concentric partition walls and the radial partition walls.

19. The chemical-mechanical polishing system of claim 15, further comprising a bottom wall connected to the radial partition walls, wherein the radial partition walls are between the bottom wall and the carrier head, and the concentric partition walls, the radial partition walls, and the bottom wall are made out of one piece of the flexible material.

20. The chemical-mechanical polishing system of claim 15, wherein the radial partition walls are curved.

* * * * *